United States Patent [19]

Booth

[11] 4,431,429

[45] Feb. 14, 1984

[54] CARPET DYEING SYSTEM

[75] Inventor: Barry R. Booth, Dalton, Ga.

[73] Assignee: RBI International Carpet Consultants, Dalton, Ga.

[21] Appl. No.: 456,194

[22] Filed: Jan. 7, 1983

Related U.S. Application Data

[63] Continuation of Ser. No. 334,301, Dec. 24, 1981, abandoned.

[51] Int. Cl.[3] ..... B08B 3/00; B21N 3/02

[52] U.S. Cl. ..... 8/477; 8/149.3; 8/152; 8/929

[58] Field of Search ..... 8/477, 149.3, 152, 929

[56] References Cited

U.S. PATENT DOCUMENTS

| | | | |
|---|---|---|---|
| 2,215,563 | 9/1940 | Ogilby | 156/148 |
| 2,768,671 | 10/1956 | Schock | 156/435 |
| 2,894,855 | 7/1959 | Wilhelm et al. | 427/245 |
| 3,488,245 | 1/1970 | Thatcher | 156/435 |
| 3,718,530 | 2/1973 | Watson | 428/96 |
| 3,719,062 | 3/1973 | Fleissner | 68/5 E |
| 4,343,835 | 8/1982 | Jones et al. | 8/477 |
| 4,391,604 | 7/1983 | Schomakers | 8/477 |

*Primary Examiner*—A. Lionel Clingman
*Attorney, Agent, or Firm*—Jones & Askew

[57] ABSTRACT

A system for continuously dyeing textile materials, such as tufted pile carpets. A carpet having a face pile on one side and a back surface on the other side is wetted with water. A foamed, steam-fixable dye liquor is deposited on the face pile of the carpet. The carpet is then introduced into a substantially closed space defined between a web substantially non-permeable to steam and a heated surface of a drum such that the back surface of the carpet is in heat transfer contact with the heated surface. The carpet remains in the space for a period of time sufficient for at least a portion of the water to be converted to steam and for the steam to fix the dye liquor on the face pile. The system can also be used to simultaneously dye the pile of a carpet and adhere a secondary backing to the carpet.

9 Claims, 3 Drawing Figures

CARPET DYEING SYSTEM

CROSS REFERENCE TO RELATED APPLICATIONS

The present application is a continuation of application Ser. No. 334,301 filed Dec. 24, 1981, now abandoned.

TECHNICAL FIELD

This invention relates to a system for dyeing textile materials, such as carpets, and, particularly, to such systems which dye textile materials in a continuous process.

BACKGROUND OF THE INVENTION

In order to make a commercially acceptable product, textile materials, such as tufted pile carpets, are typically dyed to a desirable color. The most common method used for dyeing textile materials is the vat dyeing process. The vat method is essentially a batch process wherein a quantity of textile material is added to a vat of hot dye. After sufficient time for complete penetration of the textile material by the dye, the material is removed from the vat and processed further in a steam chamber to assure complete fixation of the dye to the textile fibers. The carpet then must be washed extensively to remove all excess dye. Being a batch process, this method of dyeing is necessarily labor intensive. Furthermore, amounts of dye in excess of that necessary for dyeing the material are required and large quantities of water must be used to wash the excess dye out of the material. This washing process typically creates waste effluent treatment problems since pollution laws generally prevent the dumping of raw dyes into municipal water systems and stream, rivers, lakes or the like.

In an effort to more efficiently use dyes, and thereby reduce the waste effluent problem, systems have been developed wherein dyes are first foamed and then applied to the surface of textile materials. The foaming process permits greater control over the amount of dye applied per unit area of the textile material with the object being the use of only so much dye as is actually necessary to dye the material. When the textile material to be dyed is a tufted pile carpet, it is often difficult to obtain uniform application of dye to the pile since it is usually difficult to doctor the foam onto the pile in a uniform layer. Uniform application of the foamed dye is essential to the production of a carpet which is dyed to a uniform color and is free of streaks. In those systems in which foamed dyes have been used, the carpet with the foamed dye thereon is usually fed into a steam chamber for fixation of the dye to the pile fibers. However, in virtually all steam chambers, condensation is extensive and dripping of condensation onto the carpet often produces uneven coloration. Steam chambers require relatively large amounts of energy compared to that actually required for the fixation of the dye on the carpet. Moreover, continuous dyeing processes require that the entry and exit ends of the steam chamber be open to permit introduction and removal of the carpet, thereby resulting in further energy inefficiency.

SUMMARY OF THE INVENTION

The present invention, in one embodiment, relates to a method for continuously dyeing textile materials, such as tufted pile carpeting. A carpet having a face pile on one side and a back surface on the other side is wetted with water. A foamed, steam-fixable dye liquor is deposited on the face pile of the carpet. The carpet is then introduced into a substantially closed space defined between a web substantially non-permeable to steam and a heated surface of a drum such that the back surface of the carpet is adjacent the heated surface and is in heat transfer relationship therewith. The carpet remains in the space for a period of time sufficient for at least a portion of the water to be connected to steam and for that steam to fix the dye liquor on the face pile. The dyed carpet is than removed from the space.

Alternately, in a second embodiment, a natural or synthetic wet rubber latex compound is applied to the back surface of the carpet in place of wetting the carpet with water. When the latex coated back surface contacts the heated surface, at least a portion of the water in the latex compound is converted to steam for fixing the dye. Additionally, a secondary backing material can be adhered to the latex coated back surface of the carpet simultaneously with the dye fixation.

Accordingly, it is an object of the present invention to provide an improved system for dyeing textile materials.

Another object of the present invention is to provide a system for dyeing textile materials, such as carpets, which is relatively energy efficient.

A further object of the present invention is to provide a system for dyeing textile materials which converts water, either added to the carpet or derived from a latex compound coated thereon, to steam for fixing dye on the pile fibers.

Yet another object of the present invention is to provide a system for simultaneously dyeing and adding a secondary backing material to a carpet product.

These and other objects, features and advantages of the present invention will become apparent after a review of the following detailed description of the disclosed embodiments.

DETAILED DESCRIPTION OF THE DISCLOSED EMBODIMENT

Figure 1:
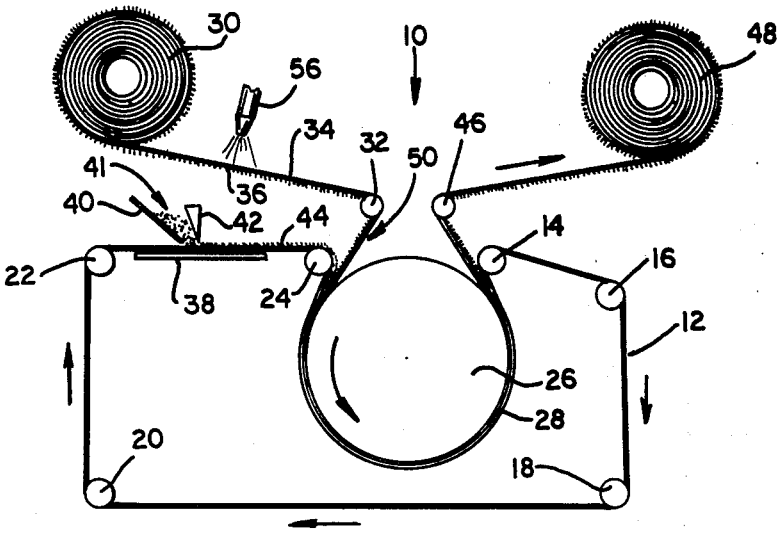
FIG. 1 is a schematic view of a first disclosed embodiment of the carpet dyeing system of the present invention.

Referring to the drawings in which like numbers indicate like elements throughout the several views, it will be seen that there is shown a carpet dyeing apparatus 10 comprising a continuous web or conveyor belt 12 movable about a plurality of guide rollers 14, 16, 18, 20, 22, 24 and a portion of the circumference of an elongate cylindrical metal drum 26. The drum 26 is pivotally supported at its ends and is rotatably driven in a counter clockwise direction by a variable speed motor (not shown). The outer surface of the drum 26 may be heated by an internal quantity of oil or other suitable liquid or by an internal heating element (not shown). Alternately, the drum 26 may be heated by super heated steam. It will therefore be appreciated by those skilled in the art that the drum 26 has an exterior surface 28 which can be heated to a desired temperature. Such drums are well known in the art and have been used extensively for heating carpet to dry a coating of latex thereon.

A supply roll 30 feeds tufted carpet backing toward the drum 26 around a guide roll 32. The carpet backing comprises a primary backing material 34 through which have been tufted a plurality of yarns to provide a face pile 36 on one side thereof.

Disposed below the belt 12 between the guide rollers 22, 24 is a flat table 38 for providing stationary support for the belt in this location. Disposed above the belt 12 and table 38, is a trough 40 for containing a quantity of foamed dye liquor 41 and for depositing it onto the belt 12. Downstream from the trough 40 is a doctor blade 42 which is selectively movable in a vertical plane toward and away from the belt 12. It will therefore be appreciated that a layer of foamed dye liquor 44 having a desired thickness can be thus deposited on the belt 12.

After the carpet feeds over the guide roller 32, it passes around the drum 26 and around a guide roller 46 to a takeup roll 48. The carpet guide roller 32 and the belt guide roller 24 are arranged so that the face pile 36 of the carpet contacts the dye coated belt 12 slightly downstream of the belt guide roller 24. At approximately the same contact location, the side of the primary backing material 34 opposite the face pile, i.e. the back surface 50 of the carpet, contacts the heated surface 28 of the drum 26. The carpet therefore occupies a space defined between the belt 12 and the heated surface 28 of the drum 26. It should be understood that the belt 12 is tensioned around the drum 26. Therefore, if the carpet were not disposed between the belt 12 and the heated surface 28, the belt would be in contact with the heated surface and no space would be defined therebetween. The carpet itself therefore provides the spacing between the belt 12 and the heated surface 28.

When the dye coated belt 12 contacts the face pile 36 and the back surface 50 of the carpet contacts the heated surface 28 of the drum 26, the carpet is squeezed therebetween. This squeezing action aids in forcing the foamed dye liquor down into the interstices of the face pile toward the bases of the tufts adjacent the primary backing material so that virtually complete coverage of the yarns forming the face pile 36 is accomplished.

Figure 2:
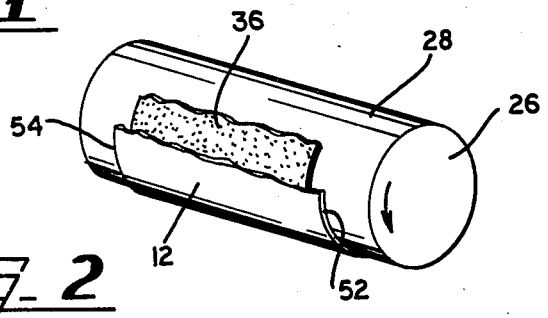
FIG. 2 is a partial perspective view of the drum shown in FIG. 1 with the belt and carpet shown partially broken away for clarity.

With particular reference in FIG. 2, it should be understood that the width of the carpet is less than the width of the belt 12. A portion of each edge 52, 54 of the belt 12 overlaps the carpet and contacts the heated surface 28 of the drum 26. Consequently, the carpet is enclosed in an envelope or a substantially closed space between the belt 12 and the heated surface 28 during its travel around the circumference of the drum 26.

A nozzle 56 disposed downstream of the supply roll 30 is directed toward the undersurface of the primary backing material 34 of the carpet. The nozzle 56 is connected to a source of water under pressure (not shown) so that a spray of water is applied to the primary backing material 34 to pre-wet the carpet before contacting the heated surface 28 of the drum 26. It is also specifically contemplated that other methods of pre-wetting the carpet can be used, such as passing the carpet through a conventional steam chamber.

The method of carpet dyeing as disclosed in FIG. 1 will now be described as follows. An undyed carpet having a face pile 36 of nylon, polyester, wool or other dyeable fiber and a primary backing material 34 of jute, woven polypropylene or other natural or synthetic material is selected. A dye liquor which is suitable for dyeing the selected face pile fiber and which can be fixed on the fiber by heating, for example with saturated steam, is also selected. Suitable surfactants, such as sodium lauryl sulfate, are added to the dye liquor in suitable amounts so that the dye liquor can be foamed. The dye liquor is foamed in a conventional manner and is delivered to the trough 40 by conventional means (not shown).

The drum 26 is rotated in a counter clockwise direction and frictionally drives the belt 12 around the guide rollers 14–24 in a clockwise direction as indicated by the arrows (FIG. 1).

The foamed dye liquor 41 in the trough 40 is deposited on the belt 12. As the belt 12 advances toward the drum 26, it passes under the doctor blade 42 which doctors the foamed dye liquor into a layer having a desired uniform thickness across the width of the belt. The thickness of the layer of foamed dye liquor on the belt 12 can be varied by moving the doctor blade 42 closer to or farther away from the belt. If the doctor blade 42 is moved farther away from the belt 12, a thicker layer of foam is provided; if moved closer, a thinner layer is provided. The desired thickness of the layer of foamed dye liquor will vary depending on the weight of the carpet to be dyed, the pile height and the required appearance of the carpet. Although many foam thicknesses can be used, the crucial consideration is the weight of dye liquor actually applied to the face yarn. It has been found that for carpets having a weight between approximately 10 ounces per square yard and 100 ounces per square yard and pile heights varying from approximately $\frac{1}{8}''$ to $1''$, dye liquor weights of from 15 ounces per square yard to 50 ounces per square yard are useful in the present invention. Normally these weights of dye liquor are foamed in a blow ratio of from 3 to 1 to 10 to 1 for air to water volume.

The doctored foam coated belt 12 advances toward the drum 26 and passes over the guide roller 24. Immediately below the guide roller 24, the dye coated belt 12 contacts the pile 36 of the carpet. At virtually the same position, the side of the primary backing material 34 opposite the pile 36 (the back surface 50 of the carpet) contacts the heated surface 28 of the drum 26. Since the primary backing material 34 is wet, the nozzle 56 having sprayed it with water, at least a portion of the water on the backing material is converted to steam when the backing material contacts the heated surface 28 which is at an elevated temperature. The particular temperature will vary depending upon the type of carpet being dyed. For example, carpets having backing material of jute can generally withstand higher drum temperatures than carpets having backing material of polypropylene. The temperature will also vary depending upon the length of time the carpet is in contact with the heated surface (dwell times). Temperatures of between approximately 250° and 350° F. and dwell times of between approximately 30 seconds and 2 minutes have been found useful. It will, of course, be appreciated that the dwell time depends on the size of the drum, the rate of rotation of the drum and the portion of the circumference of the drum which is contacted by the carpet. Each of the foregoing factors can be varied to provide the desired dwell time. It is also specifically contemplated that shorter dwell times can permit the use of higher drum temperatures and that longer dwell times can permit the use of lower drum temperatures.

Since the belt 12 is under tension, the back surface of the primary backing material 34 is held firmly in contact with the heated surface 28. A squeezing of the carpet between the belt 12 and the heated surface 28 results from the belt tension and the squeezing aids in achieving complete penetration of the foamed dye liquor into the face pile 36 of the carpet. Since the belt 12 is made of a material which is substantially non-permeable to steam (substantially non-porous), the steam which is generated when the wet backing material contacts the heated surface 28 is trapped between the belt and the heated surface. Moreover, since the width of the belt 12 is greater than the width of the carpet, so that the edges 52, 54 of the belt are in contact with the heated surface 28, the carpet is enclosed in an envelope or in a substantially closed space which acts as a minature steam chamber. The steam produced by contact of the wet carpet with the heated surface rapidly fills the substantially closed space occupied by the carpet and produces an atmosphere of saturated steam. The saturated steam atmosphere rapidly heats the face pile 28, the dye liquor thereon and fixes the dye on the face pile fibers. The tension on the belt 12 should be sufficiently great that substantially no steam escapes from the substantially closed space at the edges 52, 54 of the belt and thereby maintains the integrity of the substantially closed space.

As the drum rotates, the carpet is in contact with the heated surface 28 for a period of time sufficient for the dye liquor to be fixed on the face pile 36. After rotation of the drum, the belt 12 is removed from the face pile at the guide roller 14 and the carpet is stripped from the heated surface 28. The dyed carpet feeds around the guide roller 46 and is wound on the takeup roll 48.

Figure 3:
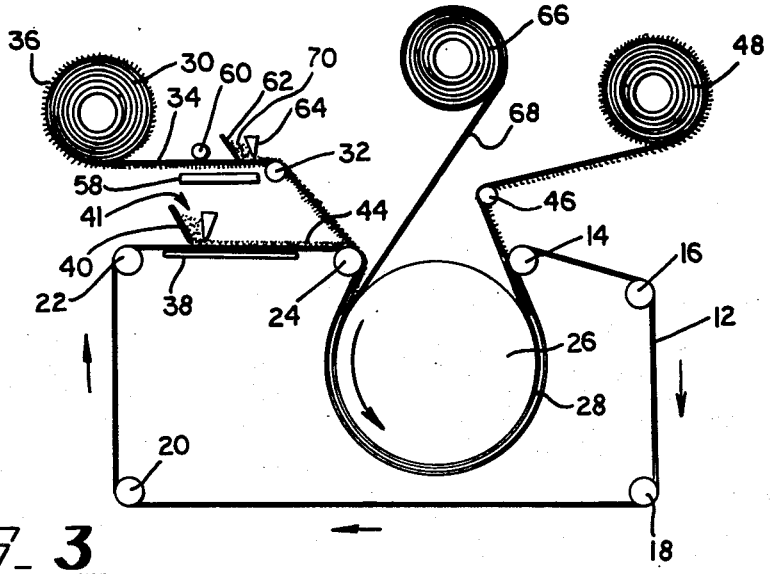
FIG. 3 is a schematic view of a second disclosed embodiment of the carpet dyeing system of the present invention.

With particular reference to FIG. 3, it will be seen that there is disclosed a second embodiment of the carpet dyeing system of the present invention. This embodiment of the invention is identical to that shown in FIG. 1 except in two respects. First, wetting of the carpet backing is replaced with a latex coating station. Second, a secondary carpet backing material can optionally be simultaneously laminated with the tufted primary backing material while the carpet dye is being fixed.

It is customary in the manufacture of tufted pile carpet to apply a coating of a wet latex compound to the back surface of the primary backing material and the pile loop backs to anchor or attach the pile elements to the backing. It is also common to use this latex compound as an adhesive to laminate a secondary backing material to the back surface of a primary backing material. The latex compound used for this purpose in addition to containing a natural or synthetic rubber latex polymer, curing agents and the like, also contains a substantial amount of water. In order to convert the latex compound to a solid, this water must be removed from the compound. This is usually achieved by heating the compound in an oven to evaporate water therefrom and dry the compound. In the present invention, the application of an aqueous latex compound to the primary backing material is substituted for the wetting of the carpet by the nozzle 56.

The latex coating station comprises a table 58 disposed below the pile side of the carpet between the guide roller 60 and a guide roller 32, a trough 62 for containing a quantity of foamed or liquid (unfoamed) latex compound and a doctor blade 64 movable in a vertical plane. A supply roll 66 of secondary backing material 68 can also optionally be provided between the tufted carpet backing supply roll 30 and the carpet take-up roll 48.

As the tufted carpet backing feeds off the supply roll 30, it passes under the guide roller 60 and over the table 58. As the carpet backing passes over the table 58, wet latex compound 70 is applied to the back surface of the primary backing material 34. As the carpet feeds toward the drum 26, it passes under the doctor blade 64 which doctors the latex compound to a desired thickness. As the carpet passes over the guide roller 24, the face pile 36 of the carpet contacts the foamed dye liquor coated belt 12. Immediately below the guide roller 24, the latex coated back surface of the primary backing material 34 contacts one side of the secondary backing 68. At approximately the same location, the other side of the secondary backing material 68 contacts the heated surface 28 of the drum 26. The heat from the heated surface quickly penetrates the secondary backing material 68 and converts part of the water in the latex compound between the primary and secondary backing materials to steam. The steam produced thereby quickly fills the substantially closed space occupied by the carpet and fixes the dye liquor on the face pile in the same manner as previously described.

The addition of the secondary backing material 68 is optional and can be omitted. It is specifically contemplated that when it is desired not to include a secondary backing, that the latex compound coated primary backing material 34 can directly contact the heated surface 28 of the drum 26. Steam will be produced by this direct contact of the latex compound with the heated surface 28 and the dye liquor will be fixed on the face pile 36 as previously described.

It should be understood, of course, when the foregoing relates only to preferred embodiments of the present invention and that numerous modifications or alterations may be made therein without departing from the spirit and scope of the invention as set forth in the appended claims.

I claim:

1. A method of dyeing a textile material, comprising the steps of:

foaming a dye liquor which is suitable for dyeing said textile material and being fixed to said textile material with steam;

wetting said textile material with water;

applying said foamed dye liquor to one side of said wetted textile material;

bringing the other side of said wetted textile material into heat transfer contact with a heated surface;

applying a web substantially non-permeable to steam to the foam coated surface of said textile material while said other side of said textile material is in contact with said heated surface;

allowing said textile material to remain in contact with said heated surface for a period of time sufficient to convert at least a portion of said water on said textile material to steam and for said steam to fix said dye liquor on said textile material; and removing said textile material from between said web and said heated surface.

2. A method of dyeing a carpet comprising a backing material and a plurality of yarns extending through said backing material to form a face pile on one side of said backing material, said method comprising the steps of:

depositing a foamed, steam-fixable dye liquor to one side of a web which is substantially non-permeable to steam;

wetting said backing material of said carpet with water;

bringing said foam coated surface of said web into contact with said foam pile of said carpet so that said framed dye liquor is deposited on said face pile;

bringing the side of said carpet opposite said face pile into heat transfer contact with a heated surface of a drum such that said carpet is disposed between said web and said heated surface;

allowing said carpet to remain in contact with said heated surface for a period of time sufficient to convert at least a portion of said water into steam and for said steam to fix said dye liquor on said pile; and removing said carpet from between said web and said heated surface.

3. A method of dyeing a carpet having a face pile on one side and a back surface on the other side, said method comprising the steps of:

wetting at least a portion of said carpet with water;

depositing a foamed, steam-fixable dye liquor on said face pile of said carpet;

introducing said carpet into a substantially closed space defined between a web which is substantially non-permeable to steam and a heated surface of a drum such that said back surface of said carpet is in heat transfer contact with said heated surface, said heated surface being at a temperature sufficient to convert water on said carpet to steam;

permitting said carpet to remain in said space for a period of time sufficient for at least a portion of said water to be converted to steam and for said steam to fix said dye liquor on said face pile; and removing said carpet from said space.

4. A method of dyeing a carpet having a face pile on one side and a back surface on the other side, said method comprising the steps of:

depositing a layer of wet latex compound on said back surface of said carpet;

depositing a foamed, steam-fixable dye liquor on said face pile of said carpet;

introducing said carpet into a substantially closed space defined between a web which is substantially non-permeable to steam and a heated surface of a drum such that said back surface of said carpet to adjacent said heated surface and in heat transfer relationship therewith, said heated surface being at a temperature sufficient to convert water in said latex compound to steam;

permitting said carpet to remain in said space for a period of time sufficient for said heated surface to convert a portion of said water in said latex compound to steam to fix said dye liquor on said face pile; and removing said carpet from said space.

5. The method of claim 4 further comprising applying a secondary carpet backing material to said layer of latex compound on said back surface of said carpet so that said secondary backing material is in heat transfer contact with said heated surface.

6. The method of claim 3 wherein the temperature of said heated surface is between approximately 250° and 350° F. and the period of time said carpet is in said space is between approximately 30 seconds and 2 minutes.

7. The method of claim 4 wherein the temperature of said heated surface is between approximately 150° and 350° F. and the period of time said carpet is in said space is between approximately 30 seconds and 2 minutes.

8. A method of dyeing a textile material comprising the steps of:

applying a foamed, steam-fixable dye liquor to a prewetted textile material;

bringing said textile material into heat transfer contact with a heated surface of a drum;

bring a web substantially non-permeable to steam into contact with said textile material so that said textile material is disposed between said web and said heated surface;

allowing said textile material to remain in contact with said heated surface for a period of time sufficient to convert at least a portion of the water in said prewetted textile material into steam and for said steam to fix said dye liquid on said textile material; and removing said textile material from between said web and said heated surface.

9. A method for dyeing a textile material comprising the steps of:

introducing a textile material including water and a foamed, steam-fixable dye thereon into a substantially closed space defined between a web which is substantially non-permeable to steam and a heated surface of a drum such that said textile material is in heat transfer relationship with said heated surface, said heated surface being at a temperature sufficient to convert water to steam;

permitting said textile material to remain in said space for a period of time sufficient for at least a portion of said water to be converted to steam and for said steam to fix said dye liquid on said textile material; and removing said textile material from said space.

* * * * *